US006360644B1

(12) United States Patent
Bettger et al.

(10) Patent No.: US 6,360,644 B1
(45) Date of Patent: Mar. 26, 2002

(54) BRAIDING MACHINE

(75) Inventors: John Leon Bettger, Greer; Daniel Richard McIntyre, Ware Shoals; William Hoyt Christian, Greenville; Toni M. Edwards, Gray Court; Audrey G. Demers Bettger, Greer, all of SC (US)

(73) Assignee: American Metric Corporation

( * ) Notice: Subject to any disclaimer, the term of this patent is extended or adjusted under 35 U.S.C. 154(b) by 0 days.

(21) Appl. No.: 09/540,085

(22) Filed: Mar. 31, 2000

(Under 37 CFR 1.47)

(51) Int. Cl.[7] ..... D04C 3/48
(52) U.S. Cl. ..... 87/33; 87/44; 87/50; 87/57
(58) Field of Search ..... 87/33, 44, 50, 87/57; 66/57, 114, 115; 96/8

(56) References Cited

U.S. PATENT DOCUMENTS

| | | | | | |
|---|---|---|---|---|---|
| 746,215 | A | | 12/1903 | Whitehead | |
| 1,328,216 | A | | 1/1920 | Walter | |
| 2,045,515 | A | * | 6/1936 | Blaisdell | 87/50 |
| 2,458,379 | A | | 1/1949 | Hobourn et al. | 87/50 |
| 3,748,952 | A | | 7/1973 | Petzetakis | 87/29 |
| 3,774,497 | A | | 11/1973 | Stahl | 87/55 |
| 3,795,171 | A | | 3/1974 | Strangfeld | 87/50 |
| 4,774,871 | A | * | 10/1988 | Jones et al. | 87/50 |
| 4,778,871 | A | | 10/1988 | Jones et al. | 87/50 |
| 4,827,707 | A | * | 5/1989 | Zoulek | 87/57 |
| 4,913,028 | A | * | 4/1990 | Yoshiya | 87/44 |
| 5,609,004 | A | * | 3/1997 | Tacy | 66/115 |

FOREIGN PATENT DOCUMENTS

| | | |
|---|---|---|
| DE | 303019 | 3/1930 |

* cited by examiner

*Primary Examiner*—John J. Calvert
*Assistant Examiner*—Shaun R Hurley
(74) *Attorney, Agent, or Firm*—Flint & Kim, P.A.

(57) ABSTRACT

A braiding machine with components comprising a support table mounting a plurality of individual segments forming a bed having a substantially circular tracking groove. Each segment comprises a segment groove which comprises a pair of opposed transfer openings formed through the outer wall with the transfer openings of adjacent segments being in contact forming the tracking groove as an endless ring. The size of the endless ring is determined by the number and size of the segments used. The tracking groove may be coated with a selected material other than the material forming the segment.

26 Claims, 7 Drawing Sheets

BRAIDING MACHINE

BACKGROUND OF THE INVENTION

This invention relates to braiding machines with a drive system comprising a gear belt which meshes with drive gears to provide a synchronized drive and which operates with reduced friction. The invention further relates to braiding machines having adjustable sized beds.

Common round braiding machines have long been known to the industry. Normally, these machines are restricted in production due to the friction between the drive gears which act to move the yarn carriers about the circular bed. An effort to increase the speed and reduce the friction was attempted by U.S. Pat. No. 4,913,028 which substituted a belt and pulley drive for the drive gears. This drive, not being positive, could not maintain synchronous motion between the machine elements.

Another feature of the usual braiding machine bed is that the camway is normally cut into a metal plate. This approach is extremely expensive and produces a final size product i.e., one whose size is not adjustable. U.S. Pat. No. 2,045,515 recognized this problem and proposed the use of individual plates which are united together to form the bed. This arrangement provided adjustability but the arrangement was cumbersome and difficult to assemble.

The disclosures of the above referred to patents are incorporated with the instant disclosure.

The instant invention has for an object a braiding machine with a positive drive which operates at low friction.

Another object of the invention is a braiding machine which may operate at increased speeds.

Another object of the invention is a braiding machine in which the camway bed is formed by a plurality of identical segments united to form a unitary bed.

Another object of the invention is a braiding machine in which the camway is adjustable in size and shape.

Another object of the invention is a braiding machine in which reduced wear and friction is achieved by selective use of the component forming materials.

Another object of the invention is a braiding machine in which components are formed selectively from metal, plastic and ceramic materials for reduced friction and increased longevity.

Another object of the invention is a braiding machine in which components are coated with one of metal, ceramic and plastic materials for increased longevity and reduced friction.

Another object of the invention is a braiding machine which may be assembled to form circular or flat braided fabric.

Another object of the invention is a braiding machine which may be adjusted to vary the number of yarn carriers.

SUMMARY OF THE INVENTION

The invention is directed to a braiding machine comprised of a support table which includes a mounting surface having an upper face and a lower face. A plurality of bearing holes are formed over the mounting surface of the support table in a prescribed substantially circular pattern. A plurality of segments are secured with the upper face of the support table with adjacent segments in mutual contact. Each segment include a bearing hole which is aligned with a respective of the bearing holes formed over the mounting surface. A drive shaft extends through and is rotably mounted in each bearing hole. A first end of each shaft, which extends above the upper face, has a drive dog secured therewith. A second end of each shaft, which extends below the lower face, has a gear secured therewith. A gear belt, which is format with teeth on its inner and outer sides, is arranged in opposing drive directions about adjacent gears with the teeth of the inner and outer sides intermeshing alternately with the teeth of each of the gears. A drive motor, which drivingly engages with the gear belt, drives the shafts in positive synchronism.

Each segment includes a substantially circular segment groove formed in it upper surface. Each segment groove includes an inner and an outer wall with a pair of transfer openings formed through the outer wall at substantially opposing locations. The area of the transfer openings of adjacent segments form the points of engagement between adjacent segments forming a bed having a tracking groove forming an endless ring of circular loops.

The inner wall of each segment groove, opposite the transfer opening, includes a transfer tip which projects slightly into the camway toward the transfer opening.

A yarn carrier, which includes a foot and a base vertically spaced above the foot, is provided. The foot is positioned beneath the drive dogs and carries a tracking pawl and a follower. The follower is adapted to be engaged with the drive dogs which act to propel the yarn carrier. The tracking pawl rides in the tracking groove as the yarn carrier is moved successively about the circular loops forming the ring. A spindle mounts the base and the foot spaced from the base. The spindle also mounts the follower which engages with the drive dogs.

The braiding machine comprises, a support table having a top, a plurality of individual segments secured on the support table forming a bed of selected configuration and size on the support table. A segment groove is formed in an upper surface of each segment. Each segment groove includes an inner and an outer wall and a pair of transfer openings formed through the outer wall in substantially opposed positions. The bed carries an endless ring formed the interconnected circles formed by each segment groove. The bed is formed to a selected size and shape dependent upon the number and shape of the segments selected.

A transfer tip is formed on the inner wall of each segment opposite the transfer opening. The transfer tip extends into the tracking groove and may be formed of a material different from the material forming the remainder of the segment. The camway may be coated any one of the materials indicated in the definition. The segments may be formed of a single material, a compound of materials and may or may not be coated with a selected polymeric compound.

Each segment includes a central bore carrying a vertically disposed drive shaft. A drive dog is secured with an upper end of each drive shaft in vertically spaced relation with the associated segment. A drive is provided which rotably drives adjacent of the shafts in opposite directions.

Each drive dog comprises a circular disk having opposed notches formed in it periphery. The notches may include an insert formed of material different than the material forming the drive dog.

A yarn carrier is provided which includes a spindle mounting a foot at one end with a base vertically spaced therefrom. The base is adapted to rest on the upper surface of respective of the drive dogs while the spindle sequentially engages with respective of the drive dogs. The foot of the yarn carrier is located between the drive dogs and the segments. Rotation of the drive shafts cause the drive dogs to move the carrier about the bed formed of individual segments.

The foot of each yarn carrier carries a tracking pawl on a lower surface. The tracking pawl engages in the tracking groove and acts to stabilize the carrier during its movement about the bed. Preferably there are two of the tracking pawls on the lower surface of each foot.

The yarn carrier may be made of a selected material or the base, the foot and/or the tracking pawl may be coated with a selected material.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
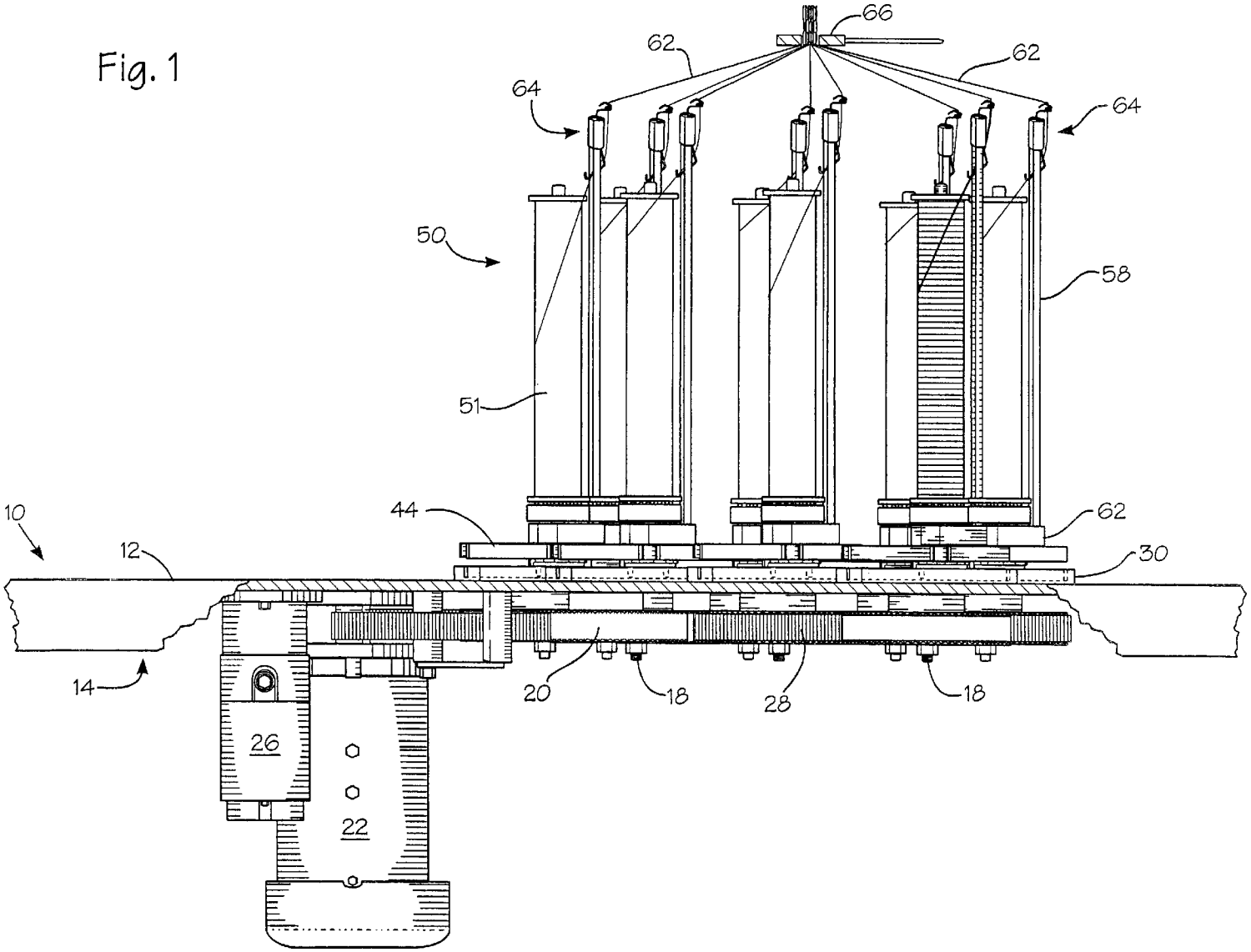
FIG. 1 is a cut away sectional side view of the braiding machine of the invention.
Figure 2:
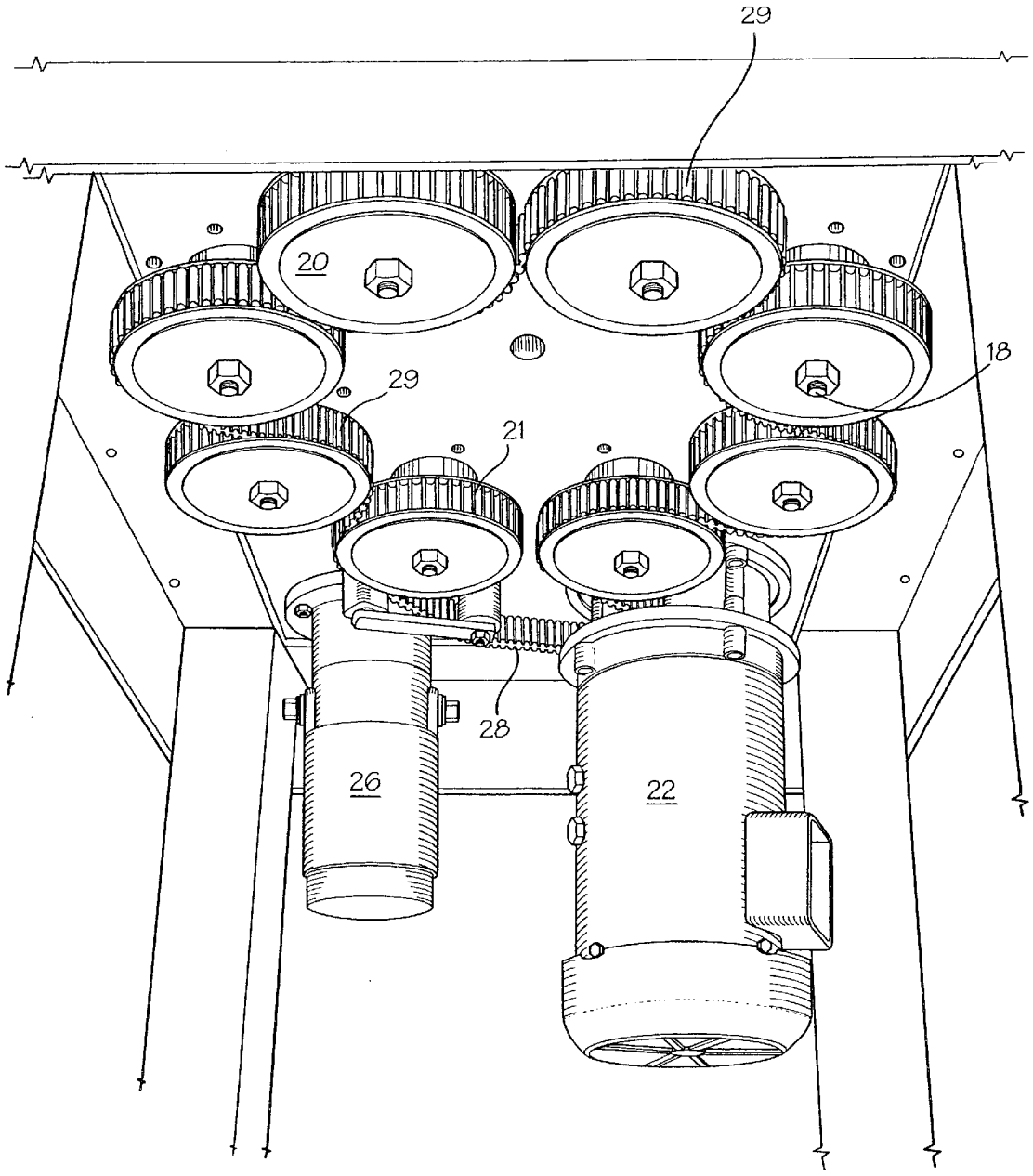
FIG. 2 is a section perspective view of the under side of the braiding machine of the invention.
Figure 5:
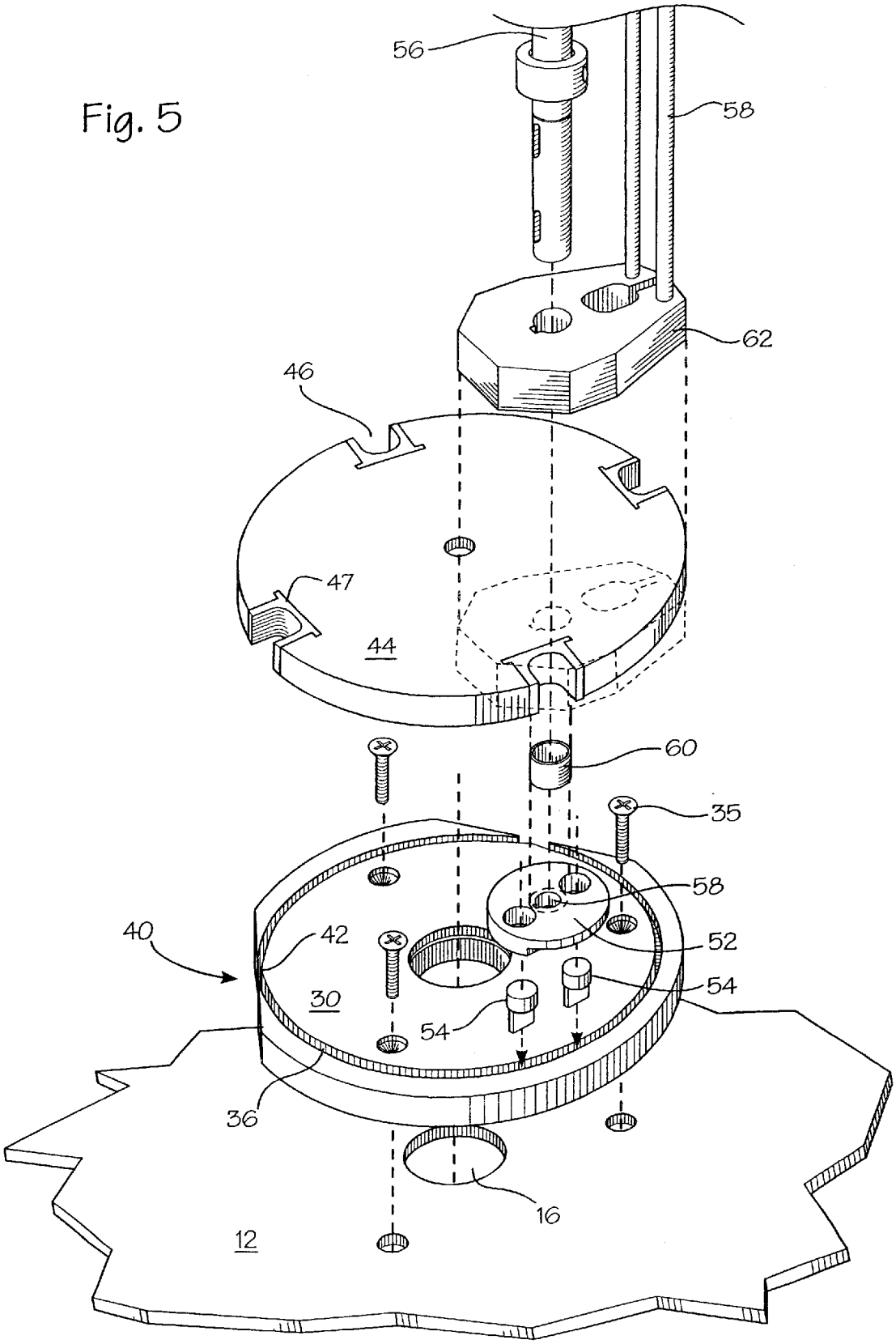
FIG. 5 is an exploded perspective view of a yarn carrier, a drive dog, a segment and a support surface.
Figure 6:
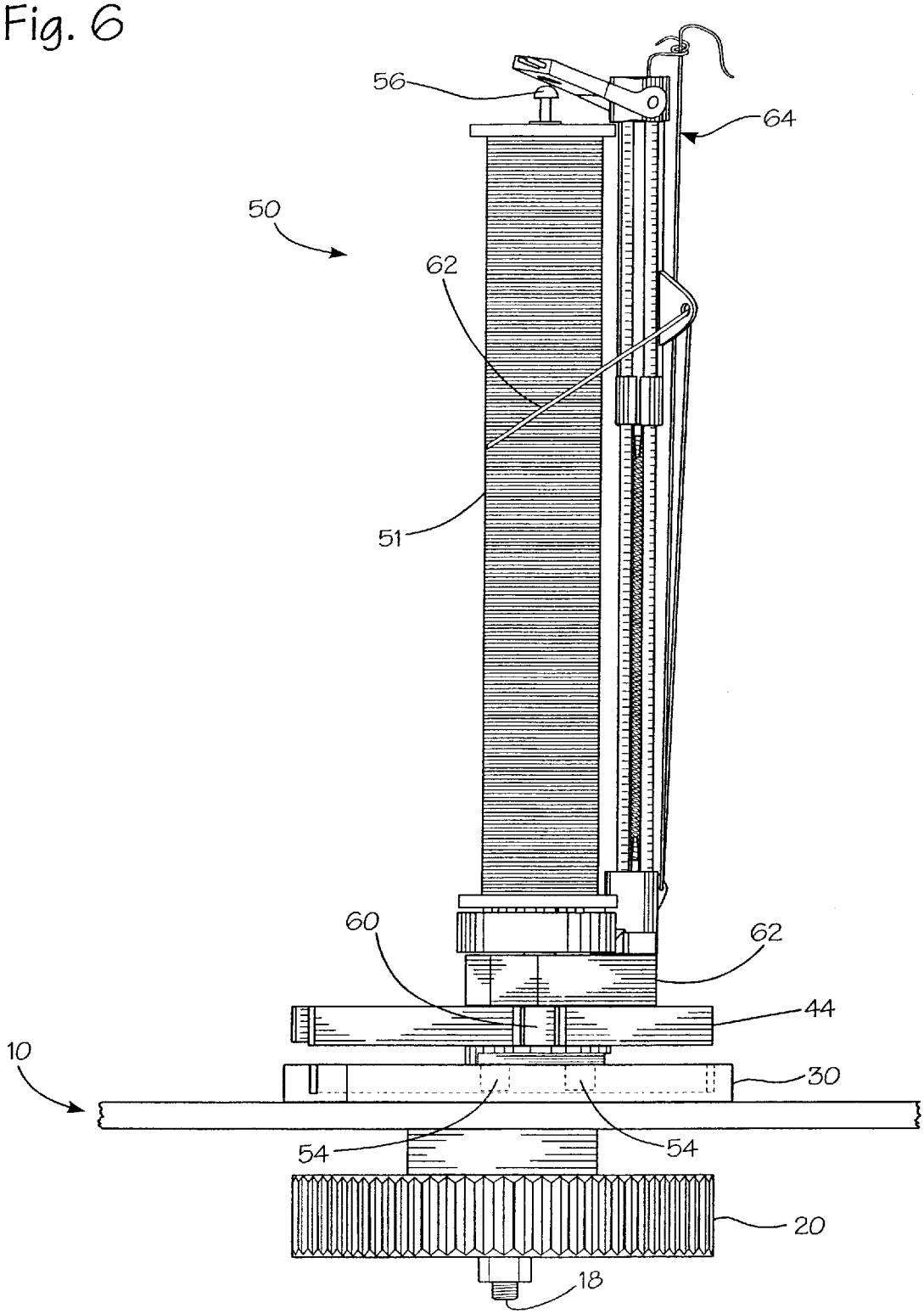
FIG. 6 is a side view of the yarn carrier and bobbin.

FIG. 1 shows the braiding machine according to the invention. The arrangement includes a support table 10 having a mounting surface which includes support or upper face 12 and a lower face 14. Mounting table 10 has a plurality of holes 16 (FIG. 5) formed through the mounting surface and arranged in a circular pattern of desired size. A shaft 18 passes through each hole 16 and is rotably mounted in a bearing. The lower end of each shaft 18 has gear 20 secured thereto.

A drive motor 22 is secured to lower face 14 of the support table adjacent the outer periphery of the arrangement of gears 20. A gear belt 28 is arranged to selectively intermesh with opposing sides of gears 20. A tensioning arrangement 24 of known construction is provided to maintain gear belt 28 under proper tension. A separate drive motor 26 is provided to drive the fabric take up which is of known structure.

Gear belt 28 is formed with teeth 29 on each side thereof. The gear belt is arranged to engage with opposite sides of adjacent gears 20. Teeth 29 of the gear belt are sized to mesh with teeth 21 of gears 20 to insure that a positive and synchronous motion is delivered from motor 22 to each shaft 18. By arranging gear belt 28 in the manner described, gears 20 are driven in opposing drive directions.

Gear belt 28 drives gears 20 with less friction, less drag and less noise than an interconnected sequence of drive gears. This capability allows the braiding machine to be driven at higher speeds and to operate with less noise and vibration.

Secured with the mounting surface or top 12 of table 10 are a plurality of segments 30. Each segment 30, which is substantially circular in shape, is formed with a plurality of mounting holes 32 and a center bore 33 including bearing surface 34. Segments 30 are secured in fixed position with mounting surface 12, by way of bolts 35, with center bore 33 aligned with bearing hole 16 forming the bed of the braiding machine.

A segment groove 36, which includes an inner and outer wall 37, 38, is formed on the upper surface of each segment 30. A substantially planar surface 41 is formed on opposed sides of each segment. Surfaces 41 are formed along an axis which cuts away a section of outer wall 38 of camway 36 forming transfer openings 40. A transfer tip 42 is formed on inner wall 37 of camway 36 centrally of opening 40. Transfer tips 42 protrude into camway 36. The transfer tip may comprise inserts of more wear resistant material than that forming the segment.

Segments 30 are secured to table 10 in a pattern of desired size and shape with planar surfaces 41 of adjacent segments in mirror engagement with each other providing that transfer tips 42 of adjacent segments are aligned. Segments 30 and segment grooves 36 form the bed normally to have an endless ring of circular loops. If desired the bed could be formed with a closed ring of circular loops so that flat fabrics could be formed.

A shaft 18 extends through each opening 33. A drive dog 44 is secured with the upper end of each shaft 18 and is vertically spaced form segments 30. Each drive dog includes a plurality of opposed recesses or notches 46 formed in it periphery. There are preferable four notches or recesses formed in each drive dog. The number could be more or less if desired. Each recess 46 preferably includes an insert 47 which is formed of a material different and preferably more wear resistant than that forming dog 44. Insert 47 may be formed of any selected material.

Figure 3:
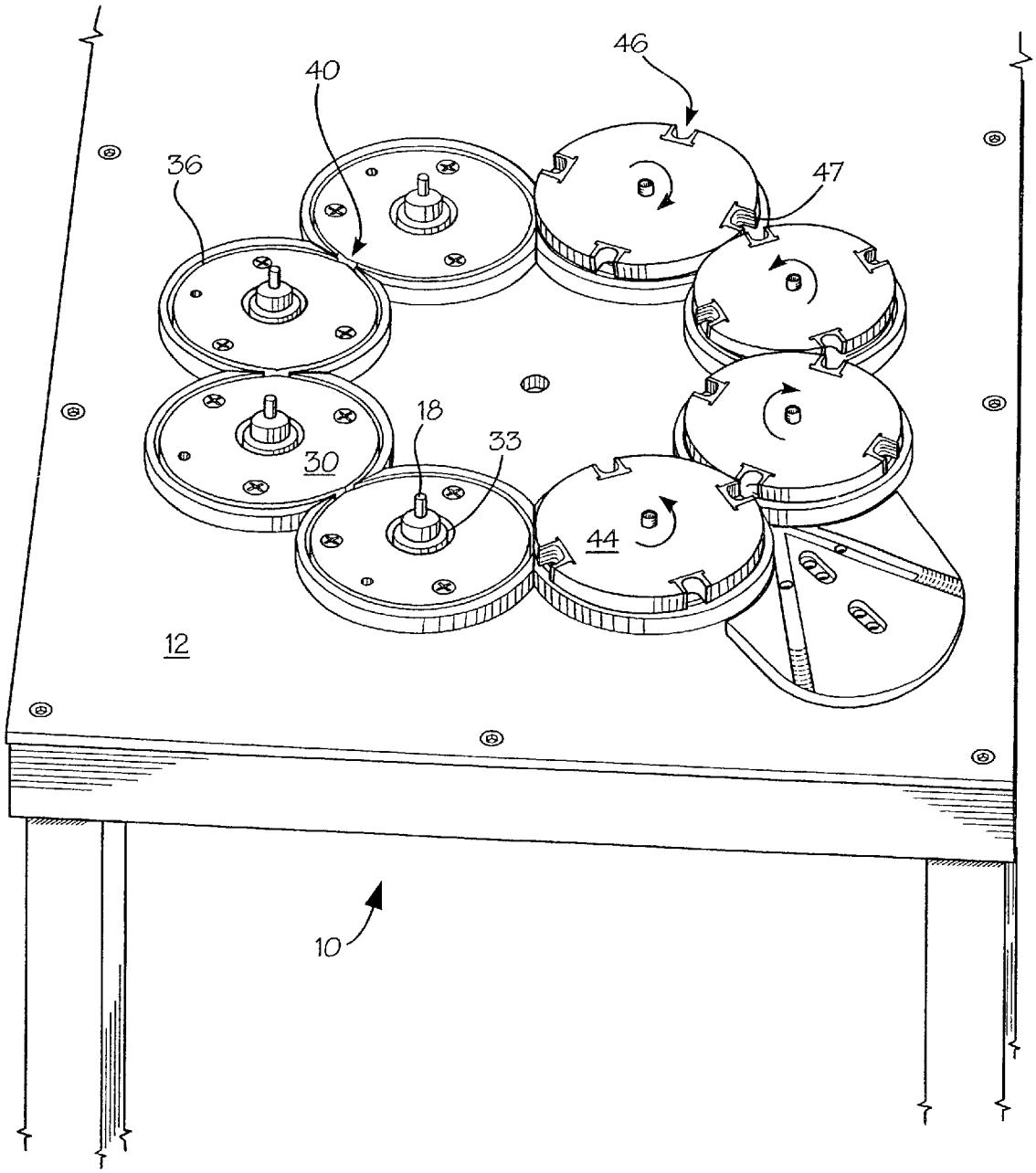
FIG. 3 is a sectional perspective view of the upper side of the support table carrying the bed of segments and drive dogs with selected drive dogs omitted.
Figure 4:
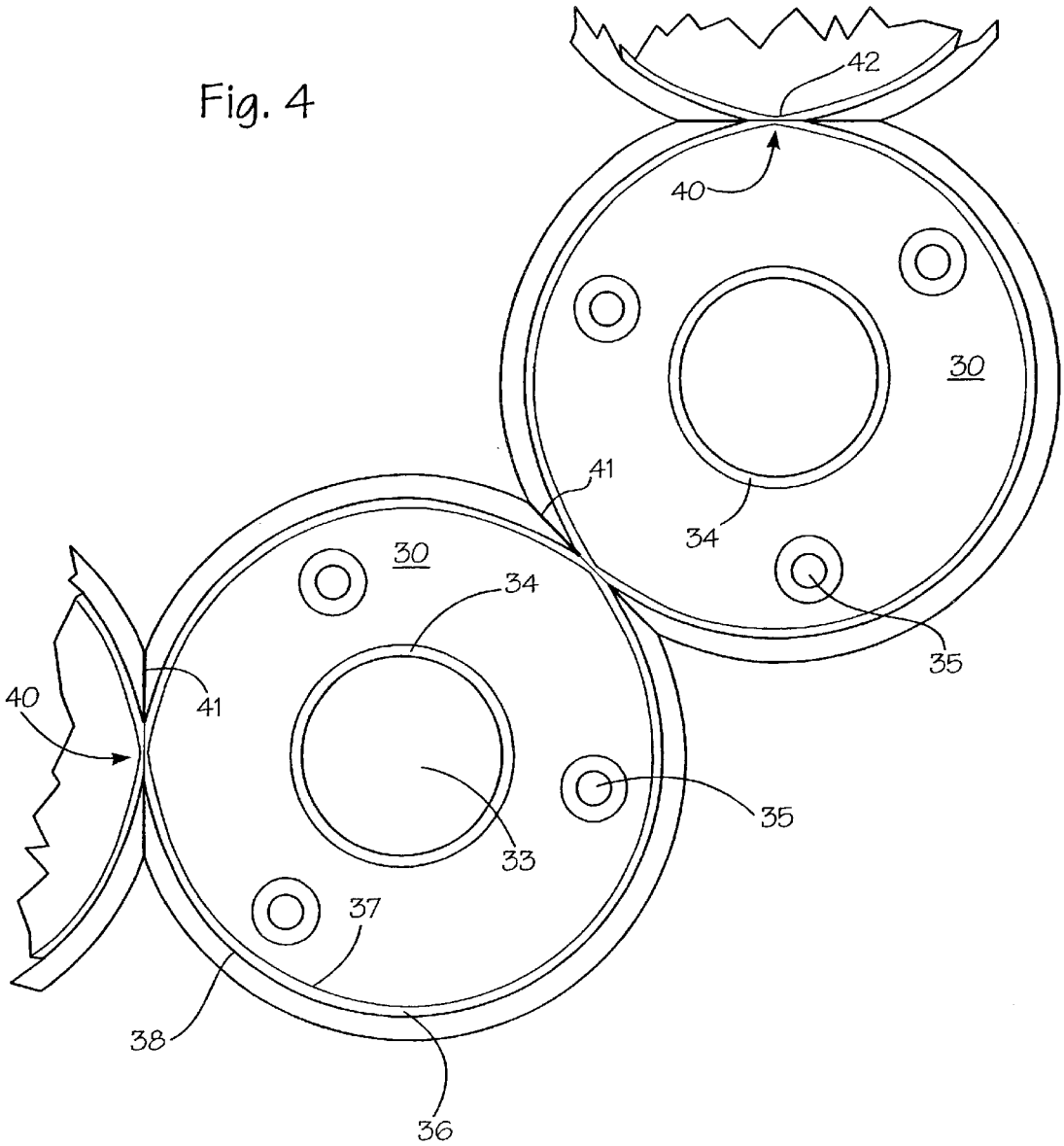
FIG. 4 is an sectional top view of a pair of segments.

Drive dogs 44 have substantially the same radius as do segments 30 so that their outer peripheries are adjacent to each other in the area of the transfer openings 40. Shafts 18 move the drive dogs 44 in opposite directions as indicated by the arrows in FIG. 3.

Yarn carriers 50, FIGS. 1, 5, 6, and 7 are provided. Each carrier moves about the ring of circles forming the bed which ring is formed by segments 30 and the plurality of drive dogs 44. Each yarn carrier includes foot 52, which carries on its lower surface, a pair of tracking pawls 54. A spindle 56 is mounted in bore 58 of foot 52 at one end. A base 62 received spindle 56 through bore 80 and is located vertically of foot 52. Ring follower 48 is carried by spindle 56 and is located between and in slightly spaced position between the base and the foot. Follower 48 rotates about spindle 56 when engaged by a drive dog.

Base 62 is of substantially rectangular shape with planer upper and lower surface. Risers 60 are positioned adjacent a first edge of the base. Spindle 56 is positioned toward the opposite edge of the base at a distance from the risers sufficient to allow clearance for the yarn carrying bobbin.

Figure 7:
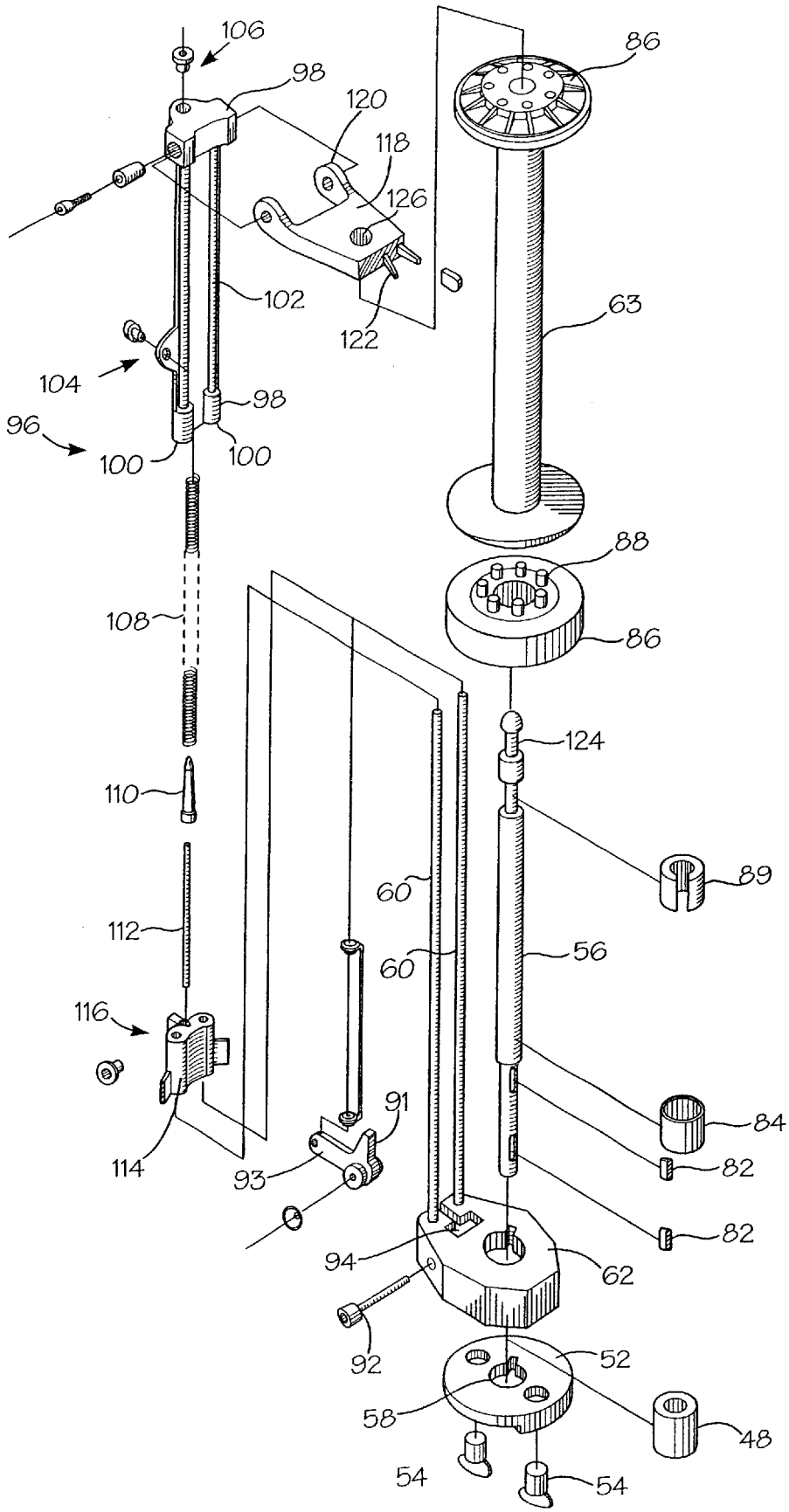
FIG. 7 is an exploded view of the yarn carrier including the bobbin.

Turning now to FIG. 7, yarn carrier 50 will be described in more detail. It is important to note that the instant structure lowers significantly the height of the yarn carrier, thus lowering its center of gravity. By arranging yarn carrier 50 in close proximity with the top of table 10 and in contact with the drive dogs 44, they tend to travel about the tracking groove with less friction and vibration, thus allowing the machine to operate at higher speeds.

As shown, spindle 56 connects with base 62 and foot 52 by way of keys 82 which engage in slots formed in each of bores 58, 80. A collar 84 is fitted about spindle 56 to be located adjacent the upper surface of base 62. A bobbin mount 86 is positioned over spindle 56 and is positioned to rotate about collar or bearing 84. The upper surface of mount 84 carries a plurality of pins 88 which engage with slots 86 formed in the lower surface of bobbin 63 and secure the bobbin in fixed relationship with mount 84. (Only slots 86 formed in the upper surface of bobbin 63 are shown.) A bushing 89 is mounted about the upper end of spindle 56 to serve as a bearing for the bobbin.

It is noted that by providing individual elements for foot 52, base 62 and spindle 56, the carrier size may easily be altered by simply installing a spindle of selected length.

A tensioning and control arrangement is mounted on risers 60. Control 96 includes upper and lower slides 98 which are received on risers 60 by slots 100. Slides 98 are interconnected by rib 102.

Rib 102 carries yarn guide 104 while upper slide 98 carries yarn guide 106. Spring 108 is received at its upper end by rib 102 while its lower end is engaged by pin 110 which is carried by rod 112. Rod 112 is secured with lower carrier 114 by way of a suitable mounting bore. Slide 114 is also slidably carried by risers 60 and includes lower yarn guide 116.

Braking pawl 90 is pivotally connected with base 62 by pin 92 so that nose 91 projects through opening 94 in base 62 when arm 93 is in its lowered position and is held below the upper face of opening 94 when arm 93 is raised. Arm 93 is suitably connected with the lower surface of lower slide 114 so as to be controlled by its movement along risers 60.

The under surface of mount 86 is formed with slots similar to slots 86 formed in the bobbin ends. These slots are adapted to engage with the end of nose 91 when it is raised through opening 94. This engagement brakes mount 88 into a fixed stop position.

Slide 98 at its upper end pivotally mounts latch 118 by way of ears 120. Opening 126 of latch 118 fits over the upper end of spindle 56 positioning latch 118 about groove 124. U-shaped resilient member 122 extend beyond opening 126 and serves to lock latch 118 in position. Latch 118 simply serves to maintain bobbin 63 in proper position on spindle 56 during operation of the machine. To change bobbins resilient member 122 is spread allowing latch 118 to be removed from spindle 56.

In practice, yarn 62 is drawn from bobbin 63, passes first through yarn guide 104, then downwardly through yarn guide 116, then upwardly through yarn guide 106, and finally to gathering section 66. When the machine is in operation, this path applies downward pressure on slides 98 which are anchored by latch 118. Lower slide 114 is forced upward along risers 60 compressing spring 108. The upward movement of lower slide 114 causes ear 94 to be lowered away from engagement with mount 86 thus allowing the bobbin to rotate and the yarn to be drawn off. Should yarn 62 break, spring 108 forces slides 98,114 apart causing ear 91 to engage the bobbin mount and stop rotation of the bobbin. Any suitable known tensioning mechanism is utilized to allow bobbin 63 to rotate at the desired speed and to maintain yarn 62 under proper tension during braiding.

Normally a stop motion of known construction is activated by this movement of the slides to stop the machine.

In operation, a plurality of yarn carriers 50, usually two per drive dog 44, are mounted on the braiding machine. Yarn 68 from each bobbin is drawn through the associated guide 64, through yarn gathering section 66 and onto a take up. Each yarn carrier 50 is connected with a drive dog 44 through the engagement of follower 48 in recess 46. The lower surface of base 62 rests on the upper surface of drive dog 44. Tracking pawls 54, extending from the lower surface of foot 52, are engaged in camway 36. The tracking pawls act to stabilize the yarn carrier as it is moved about the ring of circles formed by each of the camways segments 30 secured on table 10. Also, the tracking pawls act to cause yarn carriers 50 to pass from a first side of one segment to the opposite side of an adjacent segment as they are moved into and through the transfer openings 40. Transfer tips 42 act with each tracking pawl to deflect it from the segment groove of the segment in which it is moving into the segment groove of the adjacent segment. Alternate yarn carriers move in opposite directions about the bed ring and are driven about opposite sides of the segment loops of adjacent segments. This motion brings about braiding at gathering section 66 in the usual manner.

To achieve maximum operation speed while operating with a minimum of friction, the material forming gears 20, segments 30 and drive dogs 44 may be chosen from the identified group of desired materials. It is also noteworthy that inner and outer walls 37 and 38 of groove 36 are preferably further treated with a coating of desired material to reduce wear and friction.

By way of definition, the term material as used through with reference to the forming materials of the various structures, it is intended that such may comprise any inert material, metal, metal alloy, rubber, ceramic, synthetic, or composite thereof. Also, the material may be coated with any suitable metal, ceramic, synthetic, or composite thereof.

It is to be understood this machine as claimed is intended to include improvements of components or component forming materials which improve its performance but which are well within the scope of one skilled in the art.

While a preferred embodiment of the invention has been described using specific terms, such description is for illustrative purposes only, and it is to be understood that changes and variations may be made without departing from the spirit or scope of the following claims.

What is claimed is:

1. A braiding machine including a mounting table having a support surface comprising;

a drive system including drive with teeth gears mounted beneath said support surface, a gear belt having teeth on opposing sides, engaging on opposite sides of adjacent of said drive gears with said teeth of said gear belt and gears in intermeshing relationship, a drive motor driving said gear belt in a first direction and said gear belt driving said drive gears in alternating first and second directions;

a bed having an endless ring of circular loops formed of segment grooves located above said support surface, said segment grooves forming a tracking groove;

a drive shaft extending through each of said circular loops, each said drive shaft mounting a respective of said drive gears on a first end and a drive dog on a second end, each said drive dog being vertically spaced above a respective of said circular loops; and, a yarn carrier having a foot positioned beneath said drive dogs, said foot carrying a tracking pawl and a drive ring, said ring being in driven contact with said drive dogs and said tracking pawl being located in said tracking groove.

2. The braiding machine of claim 1 including a plurality of segments forming said segment grooves, each said segment having a bearing hole and means securing each said segment with said upper face of said mounting surface with said segment bearing holes aligned with a respective of said mounting surface bearing holes.

3. The braiding machine of claim 2 wherein each said segment groove of each said segment is in the form of a substantially circular loop.

4. The braiding machine of claim 3 wherein each said segment groove includes an inner and an outer wall and a pair of transfer openings through said outer wall.

5. The braiding machine of claim 4 wherein said inner wall of each said segment groove, opposite said transfer opening, includes a transfer tip projecting toward said transfer opening.

6. The braiding machine of claim 1 wherein said yarn carrier includes a base mounted above said drive dogs and a spindle interconnecting said foot, said ring and said base.

7. A braiding machine comprising:

a support table having a top;

a plurality of individual segments forming a bed;

a segment groove in the form of a substantially circular loop formed in an upper surface of each said segment, said segment groove having a continuous inner wall and an outer wall;

a pair of transfer openings formed through said outer wall of each said segment groove of each said segment, said transfer openings being in substantially opposed relationship;

means for securing said segments to said top with said transfer openings of adjacent of said segments being in contact forming said segment grooves of said segments into an endless ring tracking groove of said circular loops.

8. The braiding machine of claim 7 wherein said endless ring is formed to a selected size dependent upon the number and size of said segments.

9. The braiding machine of claim 7, including a transfer tip formed on said inner wall of each said segment groove opposite each said transfer opening, said transfer tip extending into said segment groove.

10. The braiding machine of claim 9 wherein said transfer tip is formed of a material different from the material forming the remainder of said segment.

11. The braiding machine of claim 7 wherein said segment groove is coated with a selected material.

12. The braiding machine of claim 7 wherein said segments are formed of a selected material.

13. The braiding machine of claim 7 wherein said upper surface of each said segment is laminated with a selected material.

14. The braiding machine of claim 7 wherein each said segment includes a central bore carrying a vertically disposed drive shaft;

a drive dog is secured with an upper end of each said drive shaft, said drive dog being vertically spaced of the associated of said segments; and, a drive rotably driving adjacent of said shafts in opposite directions.

15. The braiding machine of claim 14 wherein each said drive dog comprises a circular disk with opposed notches formed in its periphery.

16. The braiding machine of claim 15 wherein said notches include an insert of a selected material.

17. The braiding machine of claim 14 including a yarn carrier, said yarn carrier having a spindle mounting a foot at one end and a base vertically spaced from said foot, said base being adapted to rest on the upper surface of respective of said drive dogs with said spindle being releasably engaged with said respective of said drive dogs and said foot being located between said respective of said drive dogs and said segments, whereby rotation of said shaft causes said drive dogs to move said carrier about said ring.

18. The braiding machine of claim 17 wherein said foot carries a tracking pawl mounted on a lower surface thereof, said tracking pawl engaging in said tracking groove stabilizing said carrier during movement about said endless ring.

19. The braiding machine of claim 18 wherein there are two of said tracking pawls mounted on each said lower surface.

20. The braiding machine of claim 18 wherein at least a portion of said base, said foot and said tracking pawl are formed of a selected material.

21. The braiding machine of claim 18 wherein at least one of said base, said foot and said tracking pawl are each formed of one of a selected material.

22. A yarn carrier for a braiding machine comprising;

a spindle, said spindle mounting a foot at a first end and a base in fixed position spaced from said foot, said spindle and said base forming a bobbin mount above said base;

a ring rotably carried by said spindle between said base and said foot;

risers mounted on said base radially spaced from said spindle, said riser; carrying a yarn control; and a tracking pawl extending from a lower face of said foot.

23. The yarn carrier of claim 22 wherein at least one surface of said base and said foot are coated with a selected material.

24. The yarn carrier of claim 22 wherein said ring is formed of a selected material.

25. The yarn carrier of claim 22 wherein at least said base and said foot are each formed of one of a plurality of selected materials.

26. The yarn carriers of claim 22 wherein there are two of said tracking pawls extending from said lower face of said foot.

* * * * *